US007743508B2

(12) United States Patent
Shimizu

(10) Patent No.: US 7,743,508 B2
(45) **Date of Patent: *Jun. 29, 2010**

(54) ROTARY ELECTRIC SHAVER

(75) Inventor: Tetsuhiko Shimizu, Matsumoto (JP)

(73) Assignee: Izumi Products Company, Nagano (JP)

( * ) Notice: Subject to any disclaimer, the term of this patent is extended or adjusted under 35 U.S.C. 154(b) by 809 days.

This patent is subject to a terminal disclaimer.

(21) Appl. No.: 11/585,728

(22) Filed: Oct. 24, 2006

(65) Prior Publication Data

US 2007/0089298 A1 Apr. 26, 2007

(30) Foreign Application Priority Data

Oct. 25, 2005 (JP) ..... 2005-310235

(51) Int. Cl.
*B26B 19/14* (2006.01)

(52) U.S. Cl. ..... 30/43.6; 30/346.51; 30/43.4

(58) Field of Classification Search ..... 30/43.4–43.6, 30/346.51

See application file for complete search history.

(56) References Cited

U.S. PATENT DOCUMENTS 4,038,748 A * 8/1977 Tyler ..... 30/43.6
5,625,950 A * 5/1997 Sterk et al. ..... 30/43.6
5,687,481 A * 11/1997 De Boer et al. ..... 30/43.1
6,568,083 B1 * 5/2003 Taniguchi et al. ..... 30/43.2
6,823,590 B2 * 11/2004 Uchiyama et al. ..... 30/43.6

FOREIGN PATENT DOCUMENTS

| | | |
|---|---|---|
| EP | 0329244 | 8/1989 |
| EP | 1208951 | 5/2002 |
| WO | WO 9602368 A1 | 2/1996 |

* cited by examiner

*Primary Examiner*—Joseph J Hail, III
*Assistant Examiner*—Robert Scruggs
(74) *Attorney, Agent, or Firm*—William L. Androlia; H. Henry Koda

(57) ABSTRACT

A rotary electric shaver including a cutter unit 16 for holding an outer cutter 14 in an outer cutter frame 18 mounted on the shaver main body 10 and for rotationally driving an inner cutter 40 installed inside the outer cutter 14 by a rotational drive shaft 26 while pressing the inner cutter 40 elastically toward the outer cutter 14; and the shaver further including a swivel case 48 which swivels freely and moves up and down freely with the outer cutter 14, a movable panel 92 for pushing this swivel case 48 upward with a return spring 70 in between, and a push-up mechanism 94 for changing the height level (position) of the movable panel 92, so that the push-up force on the outer cutter 14 from the inner cutter side is controllable by changing the height level (position) of the movable panel 92 by the push-up mechanism 94.

8 Claims, 12 Drawing Sheets

ROTARY ELECTRIC SHAVER

BACKGROUND OF THE INVENTION

1. Field of the Invention

The present invention relates to a rotary electric shaver in which an inner cutter rotates while sliding against a substantially disc-shaped outer cutter, thus cutting hair (whiskers, etc) advanced into slits formed in the outer cutter.

2. Description of the Related Art

Electric shavers of this type are commonly known in which the feel of the shave is enhanced by making the outer cutter capable of floating up and down (capable of sinking in). In such cases, if the outer cutter is made so that it not only moves in the up-and-down direction but also tilts in any direction, so as to tilt along the curvature of the shaving surface, the tightness of the outer cutter against the shaving surface is enhanced, and the feel of the shave is further enhanced.

Making the outer cutter floatable in the up-and-down direction and also tiltable in any direction is described in Japanese Patent Application National Publication (Kohyo) PCT (WO) H9-503424/1997 U.S. Pat. No. 5,625,950. Here, a skin supporting rim (outer cutter ring) that encloses the outer circumference of the outer cutter is provided, a protrusion that protrudes outward of the outer cutter is provided in that skin supporting rim, and that protrusion is made to engage, so that it can turn, in an engagement surface on the side of an outer cutter holder (outer cutter frame). In other words, the skin supporting rim (outer cutter ring) enclosing the outer cutter is made swivel (or pivotable) relative to both the outer cutter and the outer cutter holder. That skin supporting rim functions, when the outer cutter is forcefully pressed against the skin, to prevent the outer circumferential edge of the outer cutter from burying deeply into the skin so that the shave becomes excessive or the skin is harmed.

In the shavers of Japanese Patent Application National Publication (Kohyo) PCT (WO) H9-503424/1997 U.S. Pat. No. 5,625,950, the outer circumferential side of the skin supporting rim enclosing the outer circumference of the outer cutter is made to engage the outer cutter holder so that it can turn. In other words, the skin supporting rim turns about an axis that passes through the center of the outer cutter and is parallel to the upper surface of the outer cutter (designated by K, A, A1, and A2). Moreover, the outer cutter is held so as to be movable up and down in the skin supporting rim, and the outer cutter is also pushed upward with the constant force in which the rotating shaft pushes the inner cutter up.

In general, the upward pushing pressure of the outer cutter influences both the burning sensation remaining in the skin when the hair has been shaven, and the occurrence of deep shaving. The desirable pressure varies greatly depending on personal preference and the condition of the skin and the like, so that it is undesirable to set the pressure at some universal value. Conventionally, however, that pressure (the upward pushing force on the outer cutter) has been set, model by model, at a fixed value, and that has not necessarily always agreed with the preference of the user. For that reason, dissatisfaction has arisen, with that pressure being either too strong or too weak, depending on the user. This has resulted in a limitation on the degree to which shaving comfort could be enhanced.

BRIEF SUMMARY OF THE INVENTION

An object of the present invention, which is made in view of the circumstances described above, is to provide a rotary electric shaver in which the push-up force onto the outer cutter can be set to the preference of the user, the danger of deep shaving and skin burning sensations occurring is eliminated, and shaving comfort can be enhanced.

The above object is accomplished by a unique structure of the present invention for a rotary electric shaver that includes a cutter unit for holding a substantially disc-shaped outer cutter provided in an outer cutter frame mounted on an upper part of a shaver main body housing therein a motor and for pressing an inner cutter elastically toward the outer cutter with a drive shaft which is rotationally driven by the motor and rotationally drives the inner cutter mounted from below on the inside of the outer cutter; and in the present invention, the electric saver further includes:

a swivel case to which the outer cutter is secured, the swivel case swiveling and movable up and down integrally with the outer cutter, a movable panel for pushing the swivel case upward with a return spring in between, and a push-up mechanism for changing the height level (height position) of the movable panel; and the push-up force on the outer cutter is made controllable by changing the height level (height position) of the movable panel by the push-up mechanism.

In the present invention, the outer cutter is secured to a swivel case that is freely movable up and down vertically and can freely swivel (or pivot), the swivel case is pushed upward by a movable panel by a return spring, and the height level of the movable panel is made controllable by a push-up mechanism; accordingly, it is possible to control the push-up force applied on the outer cutter from the inner cutter side. Accordingly, the push-up force on the outer cutter can be set according to the preference of the user by the push-up mechanism, and thus deep shaving is prevented, and the occurrence of burning sensations in the skin is prevented as well.

In the above structure of the rotary electric shaver of the present invention, the cutter unit comprises:

a cutter receiving base, held in the outer cutter frame, coaxially penetrated through by the drive shaft;

a swivel case holder held so as to be movable up and down within a predetermined range in the cutter receiving base, the swivel case holder having swivel case supporting portions positioned on a curved surface that opens upward from below the outer cutter;

a substantially bowl-shaped swivel case enclosing the lower portion of the inner cutter and being held by the swivel case holder so as to slide on the swivel case supporting portions of the swivel case holder and pivot in any direction;

an outer cutter ring secured so as to be detachable to the upper edge of the swivel case, thus securing the outer edge of the outer cutter to the upper edge of the swivel case; and a return spring provided in a compressed manner between the swivel case and the movable panel which is held so as to be movable up and down in the cutter receiving base, thus for returning the swivel case to a position coaxial with the drive shaft; and in this structure, the swivel case is provided to swivel together with the outer cutter by allowing the swivel case to slide on the swivel case supporting portions of the swivel case holder, and the swivel case is provided to be movable up and down together with the swivel case holder.

In this structure, the outer circumference of the outer cutter is enclosed by an outer cutter ring, both are secured integrally to the swivel case, and these elements are further made movable up and down vertically relative to a swivel case holder and a cutter receiving base. Accordingly, there will be no danger either of the outer circumferential edge of the outer cutter sinking deeply into the skin so as to effect deep shaving or of burning sensations in the skin occurring.

Moreover, in the present invention, the outer cutter ring and the outer cutter are secured to the upper edge of the swivel case covering the lower portions of the outer cutter and inner cutter from below, and the swivel case is provided so that it slides against swivel case supporting portions of the swivel case holder located below the outer cutter and inner cutter and so that it swivels or pivots in any direction. Thus, the swivel case pivots in any direction on the curved surface of the swivel case supporting portions. Meanwhile, the outer cutter is urged upward by the inner cutter that is urged upward by the drive shaft and by the return spring pushing the swivel case up; accordingly, the outer cutter ring and the outer cutter are movable up and down vertically together with the inner cutter. As a result, the outer cutter and the outer cutter ring can smoothly follow irregularities in the skin, and the enhanced feel of the shave is obtainable.

In particular, because the outer cutter, outer cutter ring, swivel case, and swivel case holder are urged upward by the return spring, the urging force acting upward on the inner cutter due to the drive shaft can be set freely irrespective of the upward urging force on the outer cutter. In other words, the contact pressure between the inner cutter and outer cutter and the upward return force (or the elastic force when sinking in) of the outer cutter can be set separately, and thus design freedom increases.

In the present invention, moreover, the return spring is provided in a compressed manner between the swivel case and the movable panel held so as to be movable up and down vertically in the cutter receiving base, and the height level of the movable panel is made adjustable by the push-up mechanism. Accordingly, the outer cutter push-up force (upward-acting return force, elasticity when sinking in) can be set freely according to the preference of the user.

Furthermore, in the present invention, the outer cutter is secured to the swivel case positioned below it, and this swivel case is held so that it can pivot by the swivel case holder positioned below that. Accordingly, the dimension of the cutter unit in the radial direction of the outer cutter does not become large. In other words, the swivel case supporting portions are located downward within the radius of the outer cutter and not outside in the radial direction of the outer cutter. For that reason, the size of the cutter head can be made smaller. Also, when a plurality of cutter units are provided, the gaps between the cutter units can be made narrower, making it possible to make the shaver head smaller and to enhance shaving comfort.

Furthermore, in the present invention, the swivel case holder is held so that it can move up and down vertically, within a predetermined range, relative to the cutter receiving base. As a result, when no downward pressure is being applied to the upper surface of the outer cutter, the outer cutter, outer cutter ring, and swivel case are pushed upward by the return spring, and the swivel case holder is pulled upward by the swivel case and stops at the upward limit position in an allowable range relative to the cutter receiving base of the swivel case holder. When, on the other hand, a downward pressure is applied evenly to the entire upper surface of the outer cutter, the outer cutter, outer cutter ring, swivel case, and swivel case holder, while compressing the return spring, descend, within an allowable range relative to the cutter receiving base of the swivel case holder, and within the range of play, in the up-and-down direction, between the swivel case and the cutter receiving base. As a result, the entire outer cutter can sink downward, and the pressure on the skin can be prevented from becoming excessive and shaving comfort is enhanced. In addition, since the inner cutter compresses the drive shaft, the repulsion force thereof is applied through the inner cutter to the outer cutter.

In the present invention, it is preferable that the center of the pivot of the swivel case, that is, the center of the curved surface where the swivel case supporting portions of the swivel case holder are located, be positioned near the center of the top surface of the outer cutter. With this structure, the swiveling motion of the outer cutter is smooth because the outer cutter swivels about a fulcrum near the center of the top surface thereof.

In the present invention, in the swivel case holder, a concave portion extending inwardly substantially along a curved surface that opens upward can be provided; and in addition, a tongue-shaped hook can be provided in the swivel case held by that swivel case holder so that the tongue-shaped hook can slide for engaging the lower surface of the concave portion of the swivel case holder from the inside. With this structure, the recoil force from the drive shaft pushing the outer cutter upward is received by the hook, and thus the movable range of the outer cutter can be made large, and the motion thereof can be made smooth.

In the present invention, the swivel case supporting portions provided in the swivel case holder are made rail-shaped along the circular arc in the radial direction positioned on a curved surface. Accordingly, the portions sliding against the swivel case is set to be along the direction of turning of the swivel case, and the pivoting or swiveling of the swivel case becomes even smoother.

In the swivel case, a cylindrical part can be provided so that it protrudes downward through the inside of the concave portion of the swivel case holder, and a conical coil spring constituting a return spring for causing the swivel case to return can be provided between the lower end of that cylindrical part and the swivel case holder. With this structure, the return force of the return spring applied to the swivel case acts more downward than the swiveling curved surface (curved surface over which the swivel case supporting portions ride), and the structure is well suited to generating a sufficient return force for returning the tilt in the swivel case and restoring the swivel case to an erect position.

The swivel case can be provided with a plurality of hooks that has tip ends bent inwardly in a hook-shape and protrude upward from the inner circumference side thereof, so that these hooks prevent the inner cutter from being separated upward from the swivel case. With this structure, the inner cutter is held in the swivel case when removing the outer cutter from the swivel case for cleaning the vicinity of the inner cutter. Thus, since the cutter blades of the inner cutter can be cleaned with the inner cutter still held in the swivel case, making the cleaning job easier.

In the present invention, it is possible that a plurality of cutter units be held in the outer cutter frame, and the outer cutters of the outer cutter units, outer cutter rings, and swivel case be made so that, respectively, they swivel or pivot freely in any direction and move freely up and down, independently; and with this structure, hair can be shaved efficiently. Since the cutter units are small in the radial direction, the gaps between the outer cutters can be made narrower, and the shaving surface of the cutter head can be made smaller, and further the cutter head can be made smaller, so that the shaver becomes easier to use. With this structure, a cutter receiving base for a plurality of cutter units can be formed integrally. Since the cutter receiving base is integrally formed, not only will the number of components be decreased, and assembly and disassembly be made easier, but also the structure is simplified.

Furthermore, in the present invention, the push-up mechanism needs only to be of a structure in which the movable panel can be pushed upward and held at a predetermined height level, and thus various mechanisms can be adopted therefor. One possibility, for example, would be a structure in which a push-up member capable of moving up and down vertically is caused to contact the lower surface of the movable panel, and the vertical, up and down positioning of the push-up member is made with a cam mechanism or the like. In this structure, an advancing and retracting member for advancing and retracting from the side below that push-up member is provided, the surface of contact between the lower surface of the push-up member and the advancing and retracting member is made to be a cam surface, and the position of advance and retraction of the advancing and retracting member is made varied by a control member.

In addition, a mechanism for advancing and retracting the advancing and retracting member can be of such a structure in which, for example, an offset wheel turned by the control member is provided, and an outer wheel is provided at one end of the advancing and retracting member, enclosing the offset wheel so as to be slidable.

DETAILED DESCRIPTION OF THE INVENTION

Figure 1:
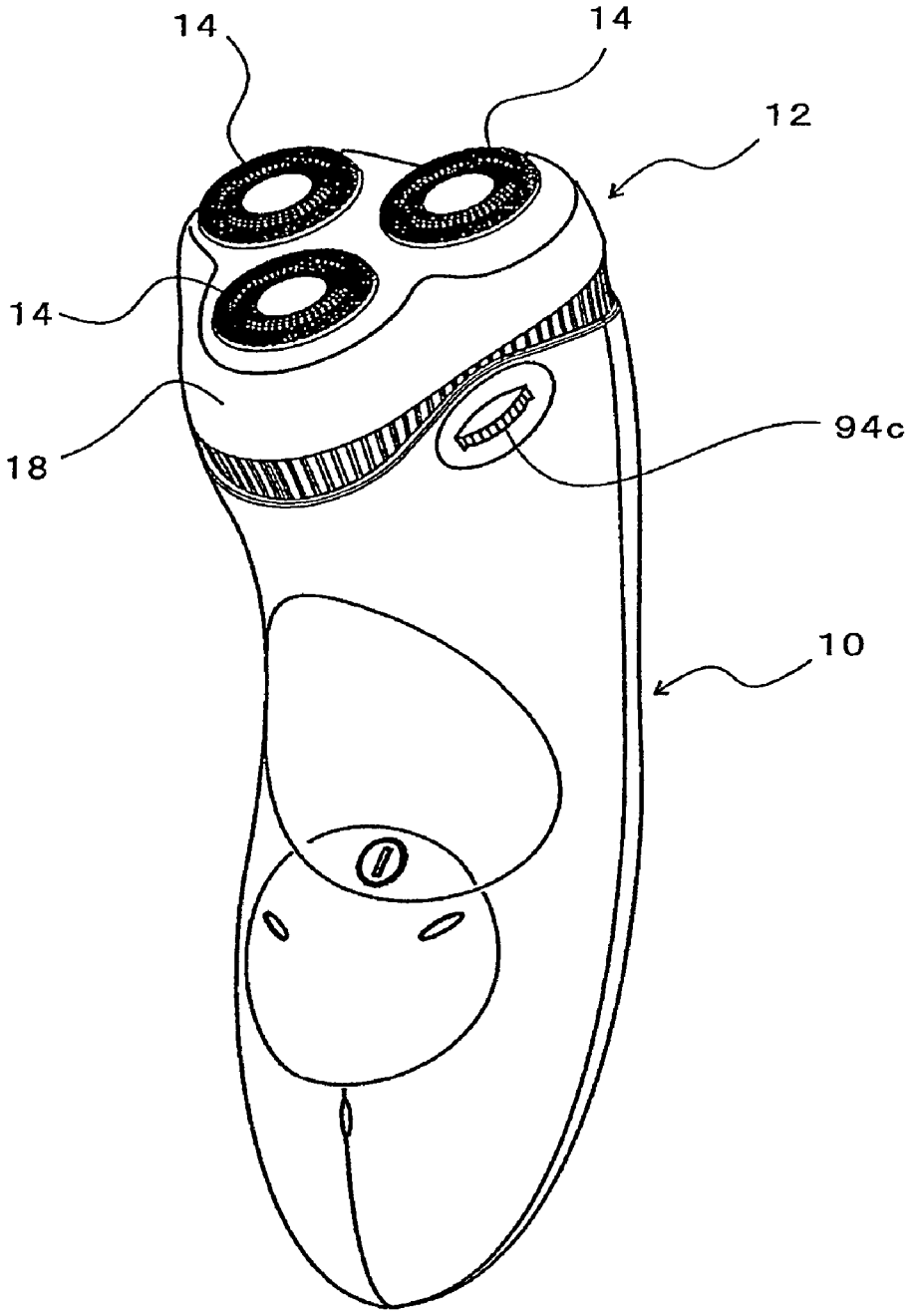
FIG. 1 is a perspective exterior view of a shaver according to one embodiment of the present invention.
Figure 2:
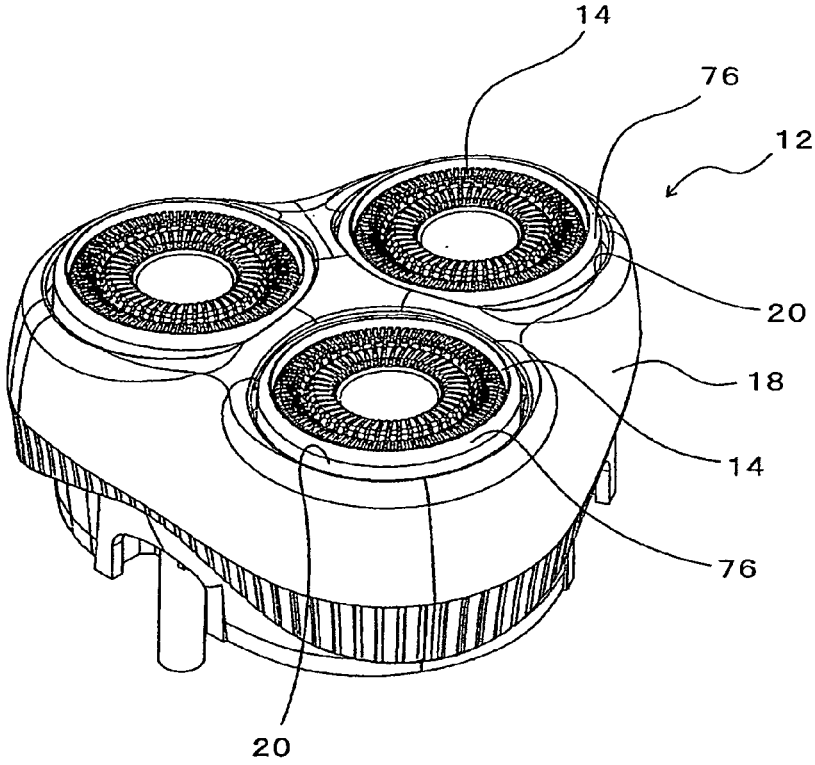
FIG. 2 is an enlarged perspective view of the cutter head thereof.
Figure 3:
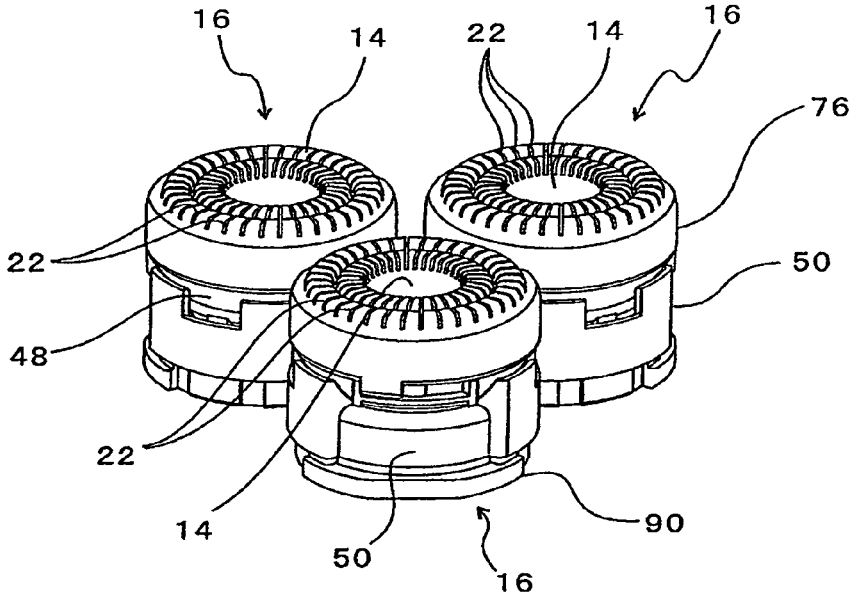
FIG. 3 is a perspective view of three cutter units.
Figure 4:
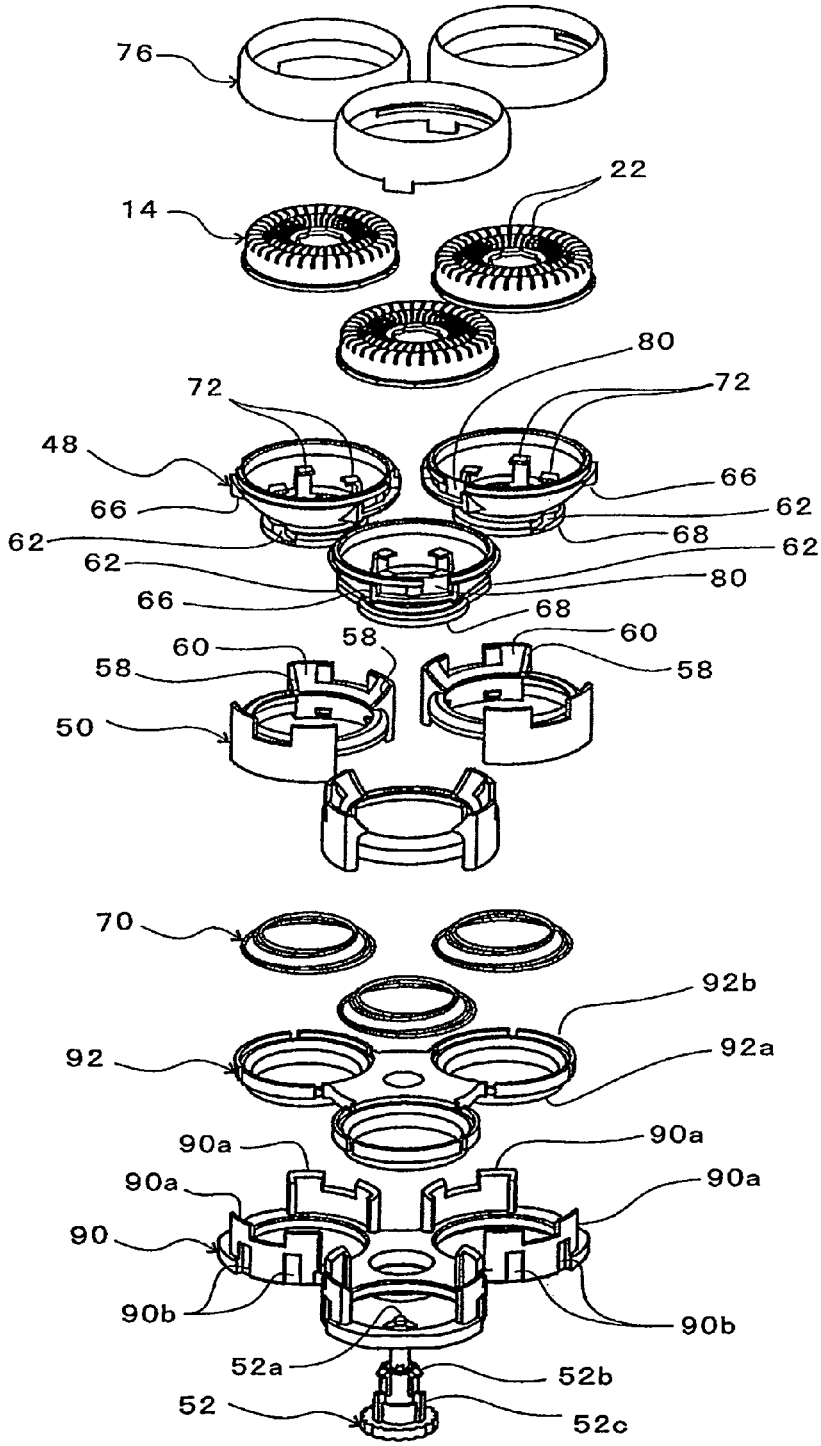
FIG. 4 an exploded perspective view of the cutter units.
Figure 6:
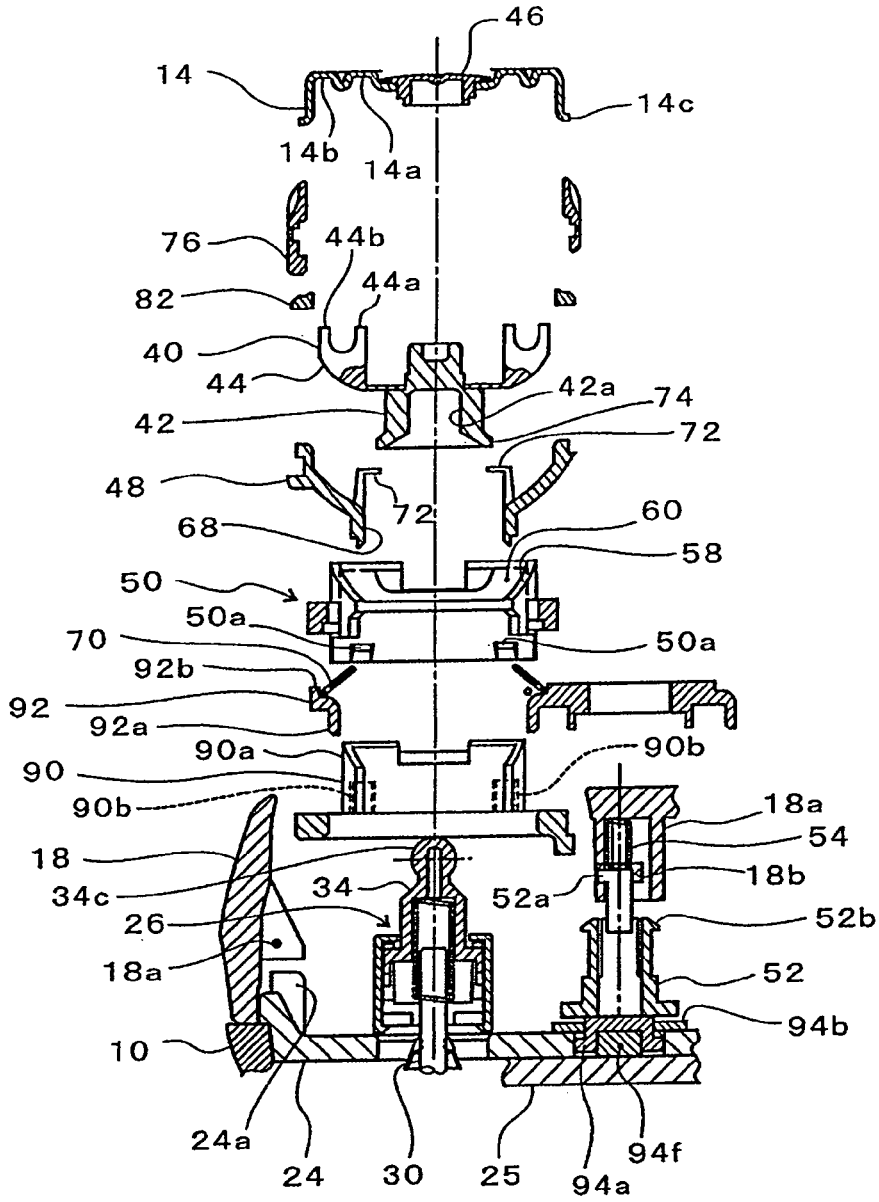
FIG. 6 is a vertical cross-sectional view of one cutter unit.
Figure 7:
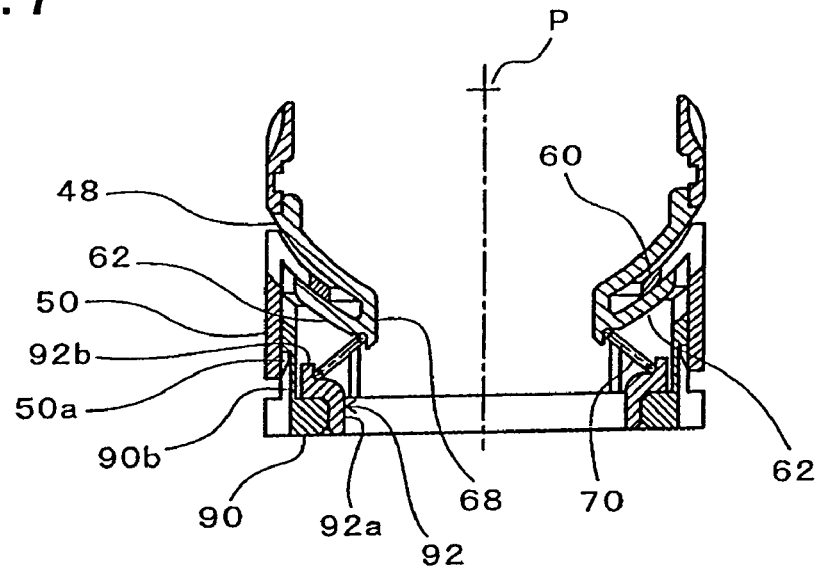
FIG. 7 is a vertical cross-sectional view of a cutter unit without the outer cutter and inner cutter.
Figure 8:
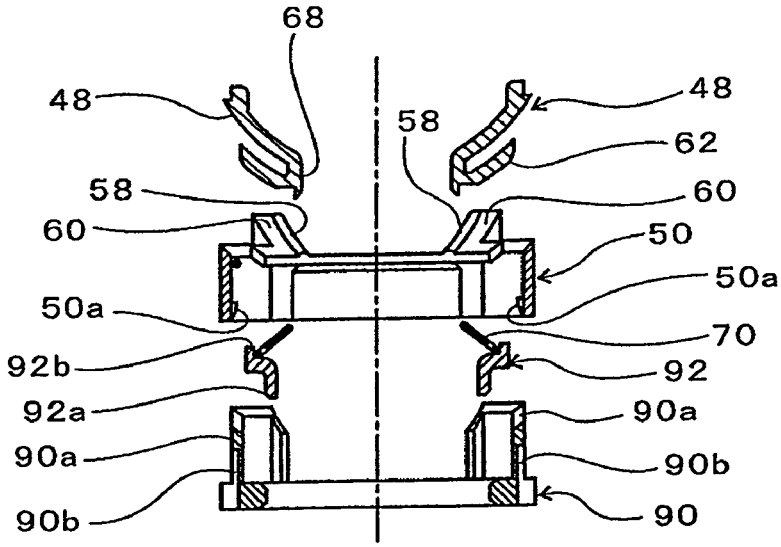
FIG. 8 is an exploded vertical cross-sectional thereof.
Figure 9:
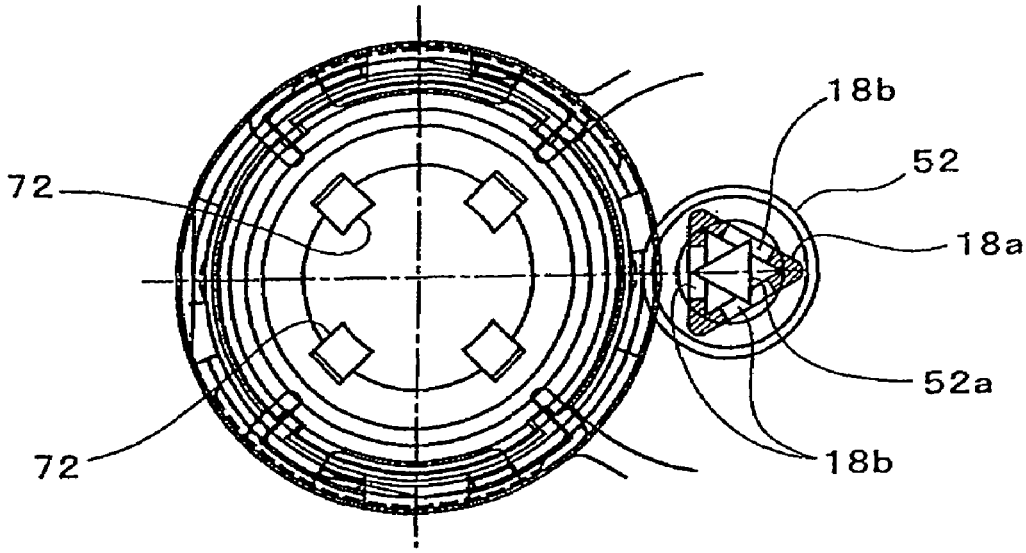
FIG. 9 is a see-through top view showing how the swivel case and swivel case holder are combined.
Figure 10:
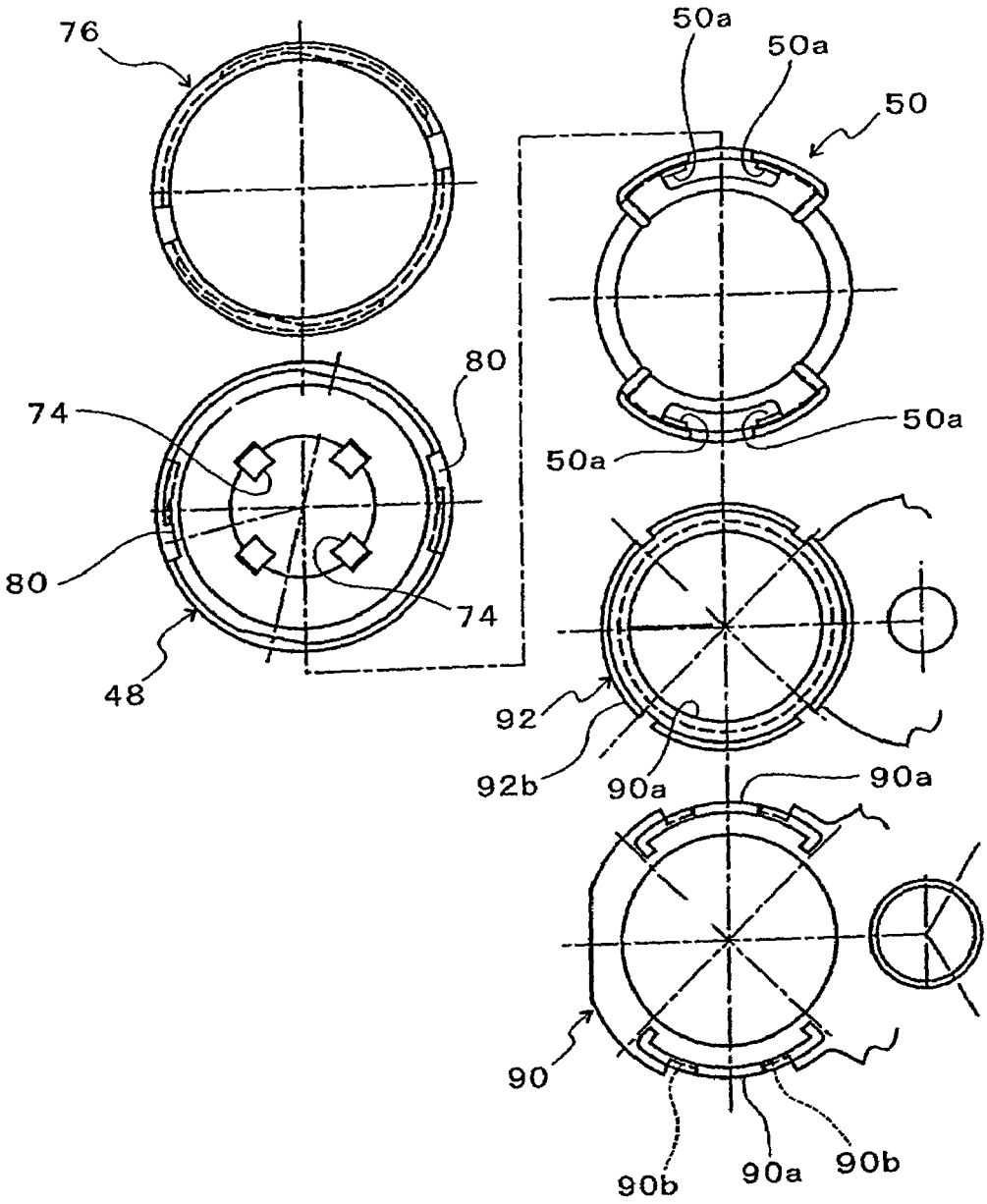
FIG. 10 is a set of top views of the various constituting elements disassembled.

FIG. 1 is a perspective exterior view of the shaver of one embodiment of the present invention, FIG. 2 is an enlarged perspective view of the cutter head thereof, FIG. 3 is a perspective view of the three cutter units used in the shaver of the present invention, FIG. 4 is an exploded perspective view of the cutter units, Figure is 5 a vertical cross-section of one cutter unit, FIG. 6 is a vertical cross-section of the cutter unit, and FIGS. 7 and 8 are a vertical cross-section and an exploded vertical cross-section without the outer cutter and inner cutter. In addition, FIG. 9 is a see-through top view showing how the swivel case and swivel case holder are combined, and FIG. 10 is a set of top views showing the various members of the shaver disassembled.

Figure 11:
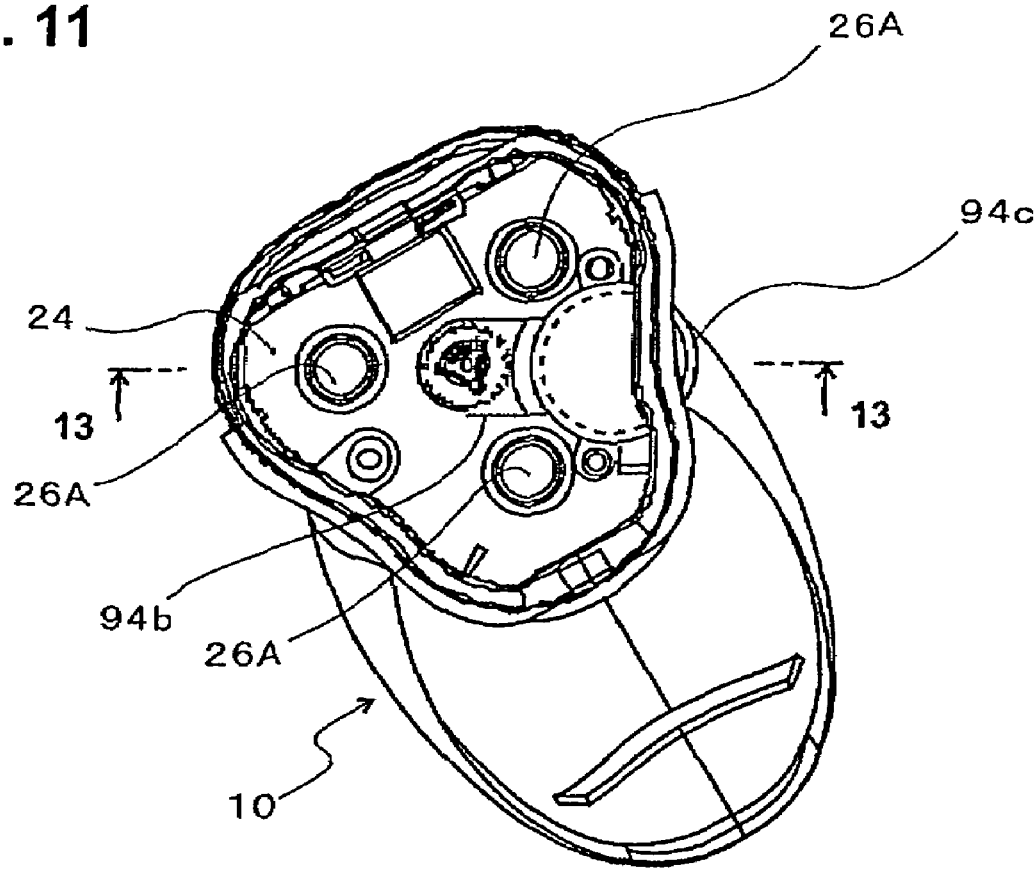
FIG. 11 shows the push-up mechanism with the head unit removed.
Figure 12:
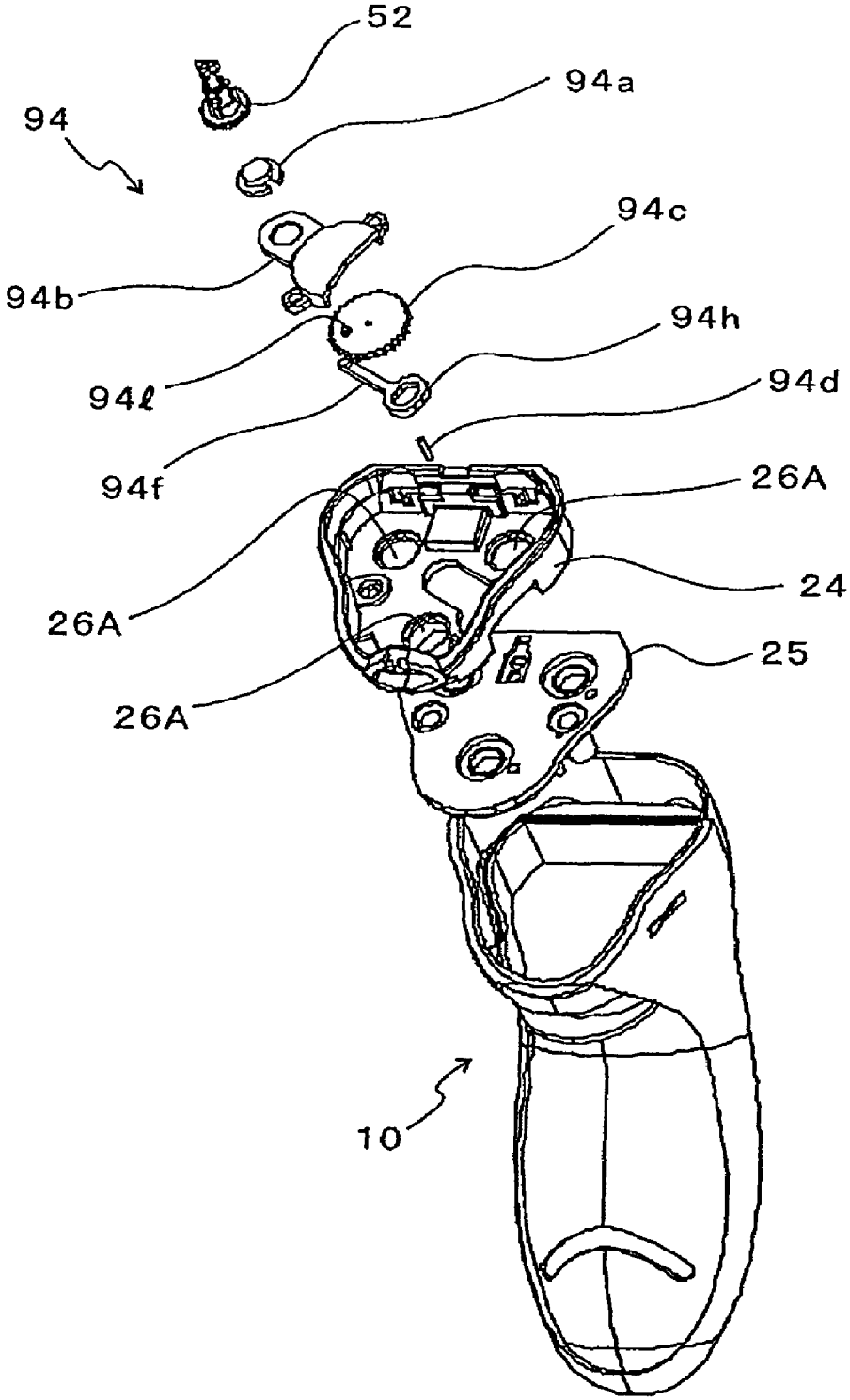
FIG. 12 is an exploded perspective view of the same.
Figure 13:
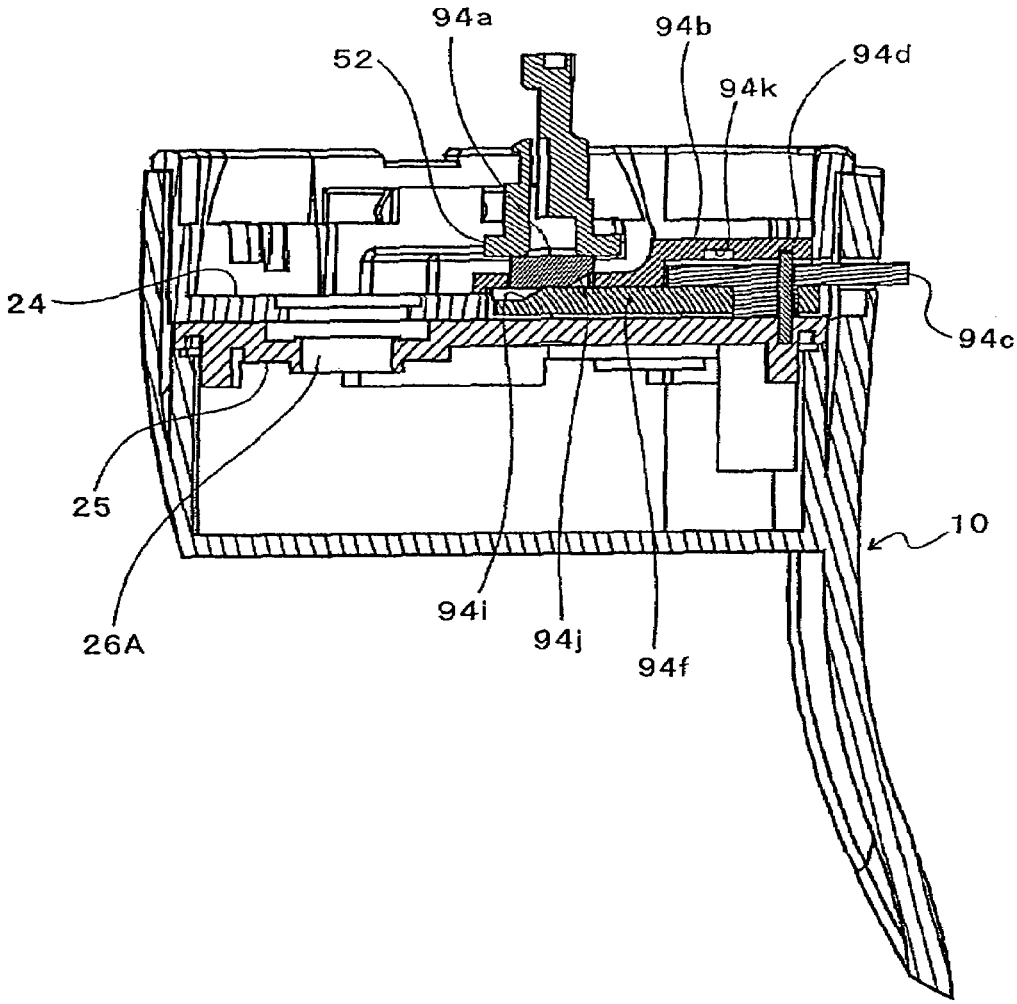
FIG. 13 is a cross-section taken along the lines 13-13 in FIG. 11.

Furthermore, FIGS. 11 to 14 illustrate the push-up mechanism of the present invention in which FIG. 11 is a top view of the shaver with the head unit 12 removed, FIG. 12 is an exploded perspective view thereof, FIG. 13 is a cross-section taken along the line 13-13 in FIG. 11, and FIGS. 14(*a*) and 14(*b*) are illustrations explaining the action of the push-up mechanism The embodiment shown below is basically a modification of the invention disclosed in Japanese Patent Application No. 2005-145013 filed by the applicant of the present patent application. The differences from the invention of the previously filed application are that in the present invention the conical spring urging the swivel case 48 upward is provided in a movable panel 92 and that in the present invention the movable panel 92 is variable in its height level (height position) by a push-up mechanism 94.

In FIG. 1, the reference numeral 10 designates a shaver main body, and 12 designates a cutter head that is attached detachably, or so that it can be opened and closed, to the upper part of that shaver main body 10. That cutter head 12 has three sets of cutter units 16 (see FIGS. 3 and 5) built in, each formed, among other elements, of an outer cutter 14, a swivel case 48 (described below), and a swivel case holder 50. Three outer cutters 14 corresponding to the three cutter units 16 are positioned so that they are respectively at the apexes of an equilateral triangle.

The cutter head 12 has an outer cutter frame 18 that is detachably mounted to the shaver main body 10. The outer cutter frame 18 can be, instead, provided on the shaver main body 10 so that it is opened and closed. In the outer cutter frame 18, three outer cutter installation holes 20 that allow the outer cutters 14 to protrude are formed (see FIG. 2). The outer cutters 14 are made of metal plate in a substantially disc-shaped cup shape. In the circular portion of the outer cutters 14, numerous slits 22 (see FIGS. 3, 4, 5) are formed in a substantially radial pattern.

Figure 5:
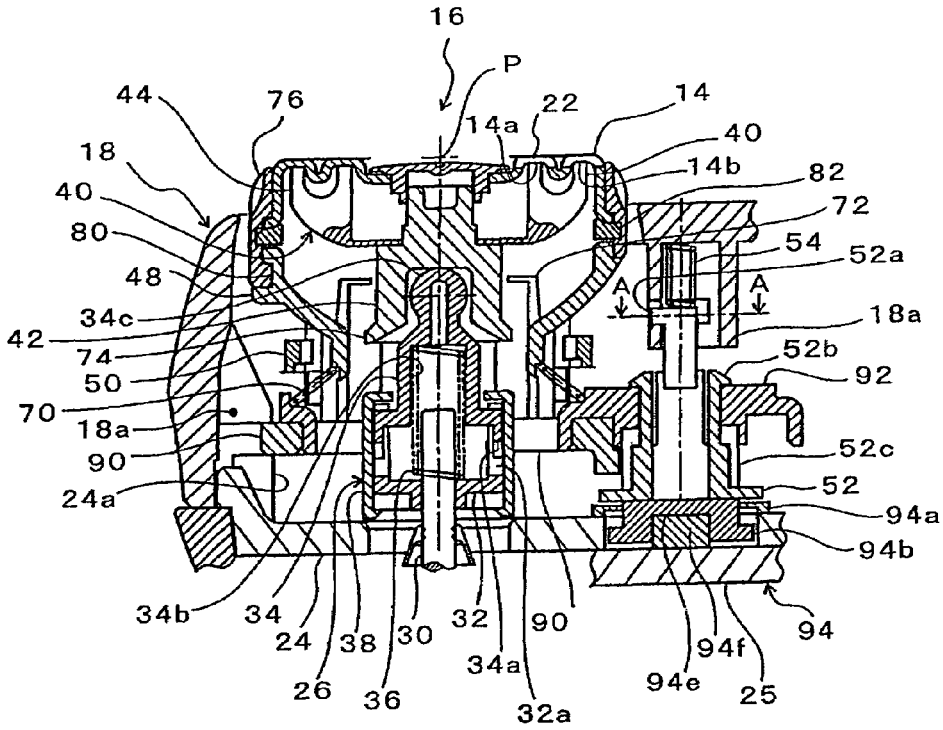
FIG. 5 shows a vertical cross-section of one cutter unit.

Into the upper surface of the shaver main body 10, a substantially triangular base panel 24 is fitted (see FIGS. 5, 11-13). Below this base panel 24, being separated therefrom, a lower base panel 25 is fitted in. From these base panels 24 and 25, three drive shafts 26, positioned below the center axes of the outer cutters 14, protrude upward (see FIGS. 5 and 6). In FIGS. 11 to 13, open holes 26A through which the drive shafts 26 pass are indicated. As shown in FIG. 5, each of the drive shafts 26 has a rotating shaft 30 rotationally driven by an electric motor (not shown) installed in the shaver main body 10, a lower joint 32 secured to that rotating shaft 30, an upper joint 34 engaged, so that it can swivel or pivot, to the lower joint 32, a compressed coil spring 36 that urges the upper joint 34 upward, and a joint cap 38 that encloses a coupling for that lower joint 32 and upper joint 34.

In the above-described drive shaft 26, the upper portion of the lower joint 32 is an expanded-diameter tube, and a plurality of grooves 32*a* is formed in its axial direction. The lower portion of the upper joint 34 is set to be in this expanded-diameter tube of the lower joint 32, and a plurality of projects 34*a*, which are projecting on the outer periphery of this lower portion of the upper joint 34 that is inside the lower joint 32, engage the grooves 32*a* of the lower joint 32 from the inside. The upper joint 34 is provided at its top end with an engagement head 34*c* that is substantially quadrilateral in top view and substantially spherical in side view.

The lower portion of the coil spring 36 is guided by the outer periphery of the rotating shaft 30, which projects inside the tube of the lower joint 32, and touches the inner bottom surface of the tube of the lower joint 32. The upper portion of the coil spring 36 touches the inner top surface of a spring fitting chamber 34*b* formed in the upper joint 34.

The joint cap 38 surrounds the outer perimeter of the tube of the lower joint 32 and engages the lower surface and aperture edge of the tube, so that the movement of joint cap 38 in the axial direction is restricted. As a result, the projections 34*a* of the upper joint 34 are prevented from coming out of the grooves 32*a* of the lower joint 32 in the upward direction.

The reference numeral 40 is an inner cutter. The inner cutter 40 has a boss part 42 made of a resin and formed into a cup shape opening downward, and a plurality of cutter blades 44 secured in a ring shape at equal intervals in the circumferential direction about that boss part 42. The cutter blades 44 can be connected to be formed into a ring shape.

As shown in FIGS. 5 and 6, ring-shaped tracks 14*a* and 14*b*, which have different diameters (or different width), are formed in the inner surface (bottom surface) of the outer cutter 14, and the upper portion of each one of the cutter blades 44 of the inner cutter 40 is bifurcated, so that the bifurcated upper portion of each one of the cutter blades 44—in other words, two cutting edges 44*a* and 44*b* (see FIG. 8)—make sliding contact from below with the tracks 14*a* and 14*b*, respectively, of the outer cutter 14.

A cap 46 that has a downwardly opening engagement hole 46*a* is provided in the center of the outer cutter 14, and as seen from FIG. 7 the upper end of the boss part 42 of the inner cutter 40 is fitted in this engagement hole 46*a*; as a result, the axial vibration of the inner cutter 40 is prevented.

As seen from FIG. 6, an engagement hole 42*a* that opens downward and has a quadrilateral shape when seen in top view is formed in the boss part 42 of the inner cutter 40, and a quadrilateral spherical engagement head 34*c* formed in the top of the upper joint 34 of the drive shaft 26 is fitted in this engagement hole 42*a* of the inner cutter 40 from below.

The reference numeral 48 is a swivel case, 50 is a swivel case holder, 90 is a ring-shaped cutter receiving base, and 92 a movable panel. The swivel case 48, as shown in FIG. 4 to 8, is formed in substantially a bowl shape which opens upward, allocated separately for each cutter unit 16. In other words, there are three swivel cases 48. Three of the cutter receiving bases 90 that correspond with three cutter units 16 are connected and integrated.

A plurality of (three) movable panels 92 are, like the cutter receiving bases 90, are connected and integrated so as to correspond to the three cutter units 16. Each of these movable panels 92 has a lower cylindrical part 92*a* for engaging the inner circumferential surface of one of the cutter receiving bases 90 and an upper larger-diameter part 92*b* for contacting the upper surface of one of the cutter receiving bases 90. The upper larger-diameter part 92*b* is formed continuous to the lower cylindrical part 92*a*, and the diameter thereof widens upward. The height level or the horizontal position of these movable panels 92 can be varied by a push-up mechanism 94. That push-up mechanism 94 will be described below.

The cutter receiving bases 90 and the movable panels 92 are held by the outer cutter frame 18 which is secured to the shaver main body 10 so as to be coaxial with the drive shafts 26. More specifically, a securing knob 52 passes through the center of the cutter receiving bases 90 and the movable panels 92; and, in this knob 52, an engagement part 52*a*, the tip end thereof is formed triangular in top view (the section at A-A line in FIG. 5 being illustrated in FIG. 9), is secured or formed integrally. This engagement part 52*a* advances from below into a column 18*a*, triangular in top view, erected in the center of the inner surface of the outer cutter frame 18, and can engage in three engagement holes 18*b* provided on the side wall of that column 18*a*.

In other words, when, by gripping the knob 52, the triangular engagement part 52*a* is advanced so that it coincides with the triangular column 18*a*, and when the knob 52 is turned approximately 60°, then the vicinities of the apexes of the triangular engagement part 52*a* engage the engagement holes 18*b* of the column 18*a*. Inside the column 18*a*, a coil spring 54 is mounted; and this coil spring 54, when the engagement part 52*a* is engaged in the engagement holes 18*b*, presses the engagement part 52*a* downward, thus preventing the knob 52 from separating from the column 18*a*.

At the upper end of the knob 52, a pawl 52*b* is formed, which passes through the center of the cutter receiving bases 90 and the movable panels 92 from below to above and engages the upper surface of the movable panels 92; and on the outer circumference of which knob 52 are formed three projections 52*c* which protrude in the outer radial direction (see FIGS. 4 and 5). As a consequence, when the movable base 92 is sandwiched between the pawl 52*b* and the projections 52*c*, it is held by the knob 52. Also, the cutter receiving bases 90 are secured by clamping the outer circumferential edges thereof between a plurality of ribs 18*a* erected on the inner surface of the outer cutter frame 18 and projections 24*a* erected on the base panel 24 (see FIGS. 5 and 6).

Thus, to the cutter receiving bases 90 held on the side of the shaver main body 10, the swivel case holders 50 are held so that there is play for slight movement in the up-and-down direction (direction parallel with the drive shafts 26). Each of the ring-shaped cutter receiving bases 90 has a pair of upright walls 90*a* and 90*a* which rise from the opposing angle positions thereof in a circular arc shape; and, on the outside of those upright walls 90*a* and 90*a*, engagement grooves 90*b* which open downward are formed, respectively, at two locations (i.e. at a total of four locations for each cutter receiving base 90) (see FIGS. 4, 6, 8).

Meanwhile, each of the swivel case holders 50 is substantially a ring-shaped and engages so that there is play for slight movement on the outside of the upright walls 90*a* and 90*a* of the cutter receiving base 90. In the inner circumferential surface of this swivel case holder 50, engagement pawls 50*a* for engaging the engagement grooves 90*b* in the cutter receiving base 90 are erected, at four locations. Accordingly, when the swivel case holder 50 is attached to the outer circumference of the upright walls 90*a* and 90*a* of the cutter receiving base 90, the engagement pawls 50*a* engage the engagement grooves 90*b*, so that the swivel case holder 50 is not separated from the cutter receiving base 90. When the swivel case holder 50 is attached to the outer circumference of the upright walls 90*a* and 90*a*, the positions of the engagement pawls 50*a* and the depths of the engagement grooves 90*b* are set so that the swivel case holder 50 has play for slight movement in the up-and-down direction relative to the cutter receiving base 90 (direction parallel to the drive shaft 26).

On the upper surfaces of each of the swivel case holders 50, a plurality of swivel case supporting portions 58 are formed so that they are provided above the centerlines of the drive shafts 26, that is, on a curved surface the center thereof is at the fulcrum P (see FIGS. 5 and 7) in the vicinity of the center of the upper surface of the outer cutters 14 (see FIGS. 4 and 8). In other words, each of the swivel case holders 50 has a pair of concave portions 60 that are spherical and arc-shaped in top view, extending inwardly from symmetrical or opposing positions with respect to the centerline, so that the two edges in the circumferential direction of the two concave portions 60 become protruding ridges that protrude slightly upward, and these protruding ridges, totaling four, become the swivel case supporting portions 58. Accordingly, the swivel case supporting portions 58 will lie along the radial direction and along circular arcs on the curved surface of the concave portions 60. These swivel case supporting portions 58 are positioned below and inside the radius of the outer cutters 14.

Each of the above-described swivel cases 48 is mounted from above to a swivel case holder 50. The lower surface of each of the swivel cases 48 is formed in a substantially curved-surface shape, and the substantially curved-surface shaped surface is supported, so that it can slide freely, by four swivel case supporting portions 58. In this swivel case 48, moreover, tongue-shaped external hooks 62 are formed for engaging the lower surfaces of the concave portions 60 from the inside of the concave portions 60 of the swivel case holder 50. One of these external hooks 62 is formed for each of the concave portions 60, for a total of two. The swivel case 48 is inserted from above into the swivel case holder 50; and, when one of the external hooks 62 is inserted under the lower surface of one of the concave portions 60 and made to follow the curved surface thereof, so as to tilt greatly to one side, by inserting the other hook 62 under the lower surface of the other concave portion 60, the swivel case 48 is provided in the swivel case holder 50.

In this condition the swivel case 48, while being prevented from being separated upward by the two external hooks 62, slides over the curved surface while sliding from above against the swivel case supporting portions 58. Furthermore, in the lower surface of each of the swivel cases 48, protrusions 66 (see FIG. 4) are formed for preventing the swivel case 48 from turning excessively in the circumferential direction. In other words, these protrusions 66 contact the edges of the concave portions 60, in the circumferential direction, of the swivel case holder 50 (the edges on the outside, in the circumferential direction, of the swivel case supporting portions 58), and they restrict the turning of the swivel case holder 50 in the circumferential direction.

Each of the swivel cases 48 has a cylindrical part 68 (see FIGS. 4 to 8) which protrudes downward, passing on the inside of the concave portions 60 of the swivel case holder 50, and a conical coil spring (or return spring) 70 is provided between the lower edge of the cylindrical part 68 and the upper larger-diameter part 92*b* of the movable panel 92. This coil spring 70 imparts a restoring force for returning the swivel case 48 to the vertical position (see FIG. 5).

At the upper edge of the cylindrical part 68 of each of the swivel cases 48, moreover, four internal hooks 72 protrude upward. These internal hooks 72 have elasticity and can be bent outwardly, and the tip ends thereof are formed to bent in hook shapes outwardly, and these tip ends face ring-shaped projection 74 (see FIGS. 5 and 6) formed in the outer circumference of the lower portion of the boss part 42 of the inner cutter 40 with a sufficient gap therebetween, so that the inner cutter 40 is prevented from being separated from the swivel case 48.

In the openings in the upper part of the swivel cases 48, the outer cutters 14 and outer cutter rings 76 are detachably attached. The outer cutter rings 76 engage flanges 14*c* (see FIG. 6) from above, formed in the outer circumferences of the outer cutters 14 and enclose the outer circumferences of the outer cutters 14, and, by engaging the two hooks 78 erected at the lower edge of each of the outer cutter rings 76, from above, into curved engagement grooves 80 provided in the outer circumferences (outer circumferences of the protrusions 66) of each of the swivel cases 48, attachment of the outer cutter rings 76 to the swivel cases 48 is effected (see FIGS. 4 and 10).

In other words, the curved engagement grooves 80 open upward and the lower portions thereof are bent in an L-shape in the circumferential direction. Meanwhile, the lower ends of the hooks 78 of the outer cutter rings 76 are engaged from above into those curved engagement grooves 80, and the outer cutter rings 76 turn in the circumferential direction along the curved engagement grooves 80. A securing ring pawl 82 is mounted between the upper edge of each of the swivel cases and the flanges 14*c* of each of the outer cutters 14, moreover, and the outer cutters 14 are secured to the outer cutter rings 76 and the swivel cases 48.

Next, the push-up mechanism 94 is described with reference to FIGS. 5, 6, and 11 to 14.

This push-up mechanism 94 causes the movable panel 92 to ascend and descend when a push-up member 94*a*, which contacts the knob 52 from below, is moved up and down, thus changing the compression force (i.e. repulsion force) of the conical coil spring 70, and thus adjusting the push-up pressure of the outer cutter 14.

The push-up member 94*a* is provided so that it can move up and down vertically by a holder 94*b* attached to the upper surface of the base panel 24. The holder 94*b* extends from the center of the base panel 24 to one side, the tip end thereof widens in a semicircular shape and contacts a flange portion which rises from the circumferential edge of the base panel 24. To this semicircular portion, a turning wheel 94*c*, as the control member, is provided, so that it is turnable by a vertical pin 94*d*. One part of the holder 94*b* protrudes on the side surface of the shaver main body 10, and a user can turn it with his/her finger (see FIGS. 1, 11, and 13).

The above-described push-up member 94*a*, as shown in FIGS. 5 and 6, can move up and down vertically inside an opening provided in the base panel 24; and the upper part of the push-up member 94*a* passes through the holder 94*b* and protrudes upward, and then contacts the lower surface of the securing knob 52. The diameter of the lower portion of the push-up member 94*a* widens, moreover, engaging the lower surface of the holder 94*b* and preventing the separation thereof.

In the lower surface of the push-up member 94*a*, a groove 94*e* is formed which passes through the center thereof, and an advancing and retracting member 94*f* is mounted, so that it can move reciprocally, between the groove 94*e* and the upper surface of the lower base panel 25. One end of this advancing and retracting member 94*f* forms an outer ring 94*h* which encloses the outer circumference of an offset ring 94*g* formed in the lower surface of the turning wheel 94*c* (see FIGS. 12 to 14). Accordingly, by turning the turning wheel 94*c*, the advancing and retracting member 94*f* advances and retracts while swiveling slightly about the push-up member 94*a* as a fulcrum.

In the upper surface of the advancing and retracting member 94*f* and the upper surface on the inside of the groove 94*e* of the push-up member 94*a*, cam surfaces 94*i* and 94*j* are formed respectively; and the push-up member 94*a* ascends and descends by the advancing and retracting motions of the advancing and retracting member 94*f*, so that the amount the push-up member 94*a* ascends and descends depends upon the amount of engagement between the cum surfaces 94*i* and 94*j*.

Figure 14A:
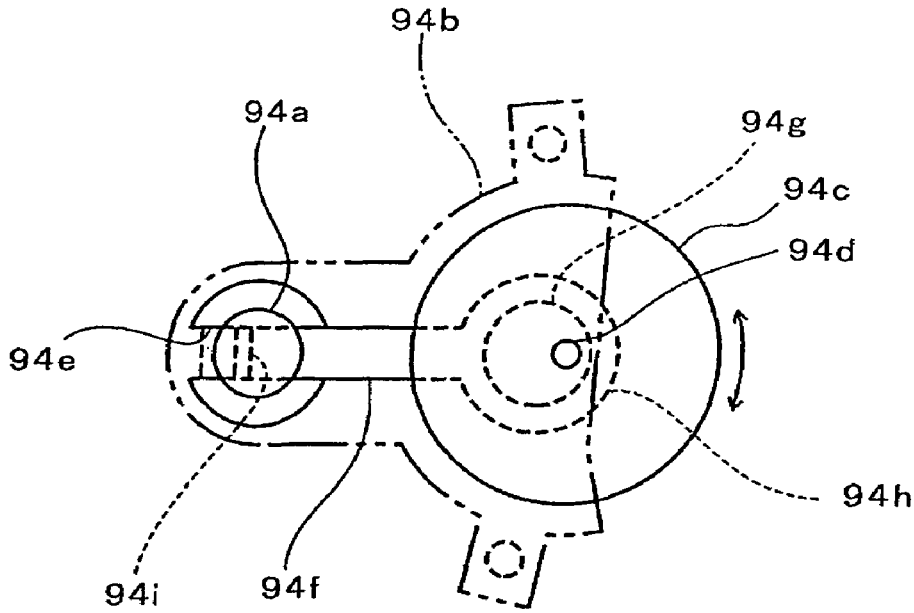
FIGS. 14(*a*) and 14(*b*) illustrate the actions of the push-up mechanism.
Figure 14B:
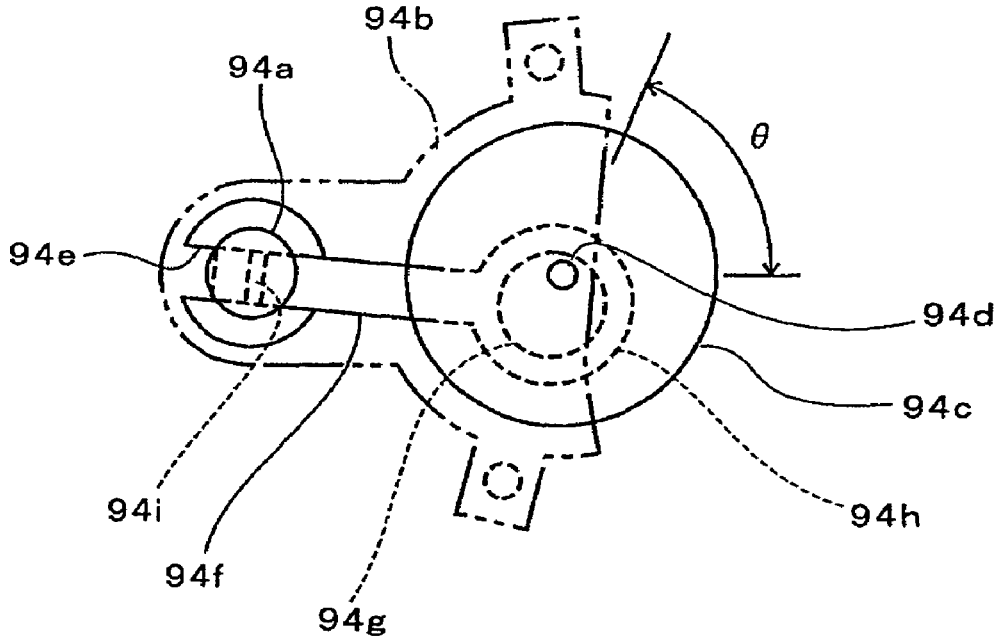

FIGS. 14 (A) and 14(B) illustrate how the turning position of the turning wheel 94*c* is changed. In FIG. 14(B), the turning wheel 94*c* is turned by an angle θ from the position shown in FIG. 14(A).

In FIG. 13, a concavity 94*k* formed in the inner surface of the holder 94*b* has a circular arc shape centered on a pin 94*d*. By causing a projection 94*l* (see FIG. 12) erected on the turning wheel 94*c* to be engaged therein, the turning range of the turning wheel 94*c* is restricted. A part of the turning wheel 94*c* passes through a flange in the base panel 24 and pokes out from the side surface of the shaver main body 10 as described earlier (see FIGS. 1, 11, and 13).

The action of the shaver of the above embodiment will be described next.

In the condition as shown in FIG. 5, in other words, when no outside force is being applied to the outer cutter 14, the upper joint 34 of the drive shaft 26 is urged upward by the coil spring 36, so that the inner cutter 40 and outer cutter 14 are urged upward. The flanges 14*c* of the outer cutter 14 urge the outer cutter ring 76 and swivel case 48 upward. The external hooks 62 of the swivel case 48 are engaged in the lower surface of the concave portions 60 of the swivel case holder 50, so that, because of the external hooks 62, the cutter unit 16 is restricted from protruding upward and is maintained in the position illustrated in FIG. 5.

As for the swivel case holders 50, the engagement pawls 50*a* are fastened in the engagement grooves 90*b* of the cutter receiving base 90, and the cutter receiving base 90 is held by the projections 24*a* and the ribs 18*a*. As a result, the swivel case holder 50 does not move upward. The inner cutter 40 is rotated by the rotation of the drive shaft 26, and hair that has entered through the slots 22 of the outer cutter 14 is cut by the inner cutter 40.

When, in FIG. 5, an outside force is applied vertically downward to the center or to the entire surface of the outer cutter 14 upon shaving, the outer cutter 14, while compressing the upper joint 34, descends within a certain range relative to the cutter receiving base 90. In other words, the amount by which the outer cutter 14 descends is such that, because the flanges 14*c* of the outer cutter 14 are secured to the outer cutter ring 76, the swivel case 48 moves down vertically within the range of play in the up-and-down direction relative to the swivel case holder 50, and the swivel case holder 50 moves down vertically within the movable range relative to the cutter receiving base 90, so that, as a result, the conical coil spring 70 is compressed.

When an outside force is applied downward to a part of the outer circumference of the outer cutter 14 (a position offset from the center), the outer cutter 14 tilts; and, as a result, the swivel case 48 swivel together with the outer cutter ring 76. In other words, the lower surface of the swivel case 48 slides over the swivel case supporting portions 58 of the swivel case holder 50; and the outer cutter 14 swivels, while compressing the conical coil spring 70 in the radial direction, about the fulcrum P in the vicinity of the center of the upper surface of the outer cutter 14. Accordingly, the outer cutter 14 tilts and follows the irregularities of the surface of the skin, so that excellent feeling of shaving is obtained.

Thus, when the outer cutter 14 and the swivel case 48 tilt, the upper joint 34 of the drive shaft 26 tilts in the opposite direction. Under this condition, the rotation of the drive shaft 26 is transmitted to the inner cutter 40, the cutting edges 44*a* and 44*b* of the inner cutter 40 rotate while sliding against the inner surfaces (lower surfaces) of the tracks 14*a* and 14*b* of the outer cutter 14, and thus cutting the hair.

When the outside force being applied to the outer cutter 14 ceases, the swivel case 48 is pushed back in the return direction (toward outer cutter) by the conical coil spring (return) 70; and the drive shaft 26 also returns to the vertical position illustrated in FIG. 5.

The push-up force on the outer cutter 14 caused by the conical coil spring 70 can be adjusted by the push-up mechanism 94. More specifically, when the turning wheel 94*c* is turned as shown in FIG. 14(*a*), the advancing and retracting member 94*f* advances or retracts inside the groove 94*e* of the push-up member 94*a*. As a result, the push-up member 94*a* ascends or descends due to the sliding motion of the cam surfaces 94*i* and 94*j* (see FIG. 13). The cam surfaces 94*i* and 94*j* are formed as inclined surfaces capable of mutually engageable, so that, the push-up member 94*a* ascends when the advancing and retracting member 94*f* advances (towards left in FIG. 13) inside the groove 94*e*, and, conversely, the push-up member 94*a* descends when the advancing and retracting member 94*f* retracts (withdraws towards right in FIG. 13 and as shown in FIG. 14(*b*)) from the groove 94*e*. In other words, the height level (height position) of the push-up member 94*a* is set to be a desired position by way of varying the amount of engagement between the cam surface 94*i* of the advancing and retracting member 94*f* and the cam surface 94*j* of the push-up member 94*a*.

When the push-up member 94*a* ascends, the coil spring (return) 70 is compressed, and thus the pushing-down force (restorative force when pushed down during shaving) of the outer cutter 14 becomes greater. Conversely, when the push-up member 94*a* descends, the pushing-down force of the outer cutter 14 becomes smaller. Because the pushing-down force of the outer cutter 14 can thus be suitably set according to the preference of the user, deep shaving and burning sensations can be prevented.

The invention claimed is:

1. A rotary electric shaver comprising a cutter unit for holding a substantially disc-shaped outer cutter provided in an outer cutter frame mounted on an upper part of a shaver main body housing therein a motor and for pressing an inner cutter elastically toward the outer cutter with a drive shaft which is rotationally driven by said motor and rotationally drives said inner cutter mounted from below on the inside of said outer cutter; said electric saver further comprising:

a swivel case to which said outer cutter is secured, said swivel case swiveling and movable up and down integrally with said outer cutter;

a movable panel for pushing said swivel case upward with a return spring in between; and a push-up mechanism for changing a height level of said movable panel; and wherein:

a push-up force on said outer cutter is made controllable by changing a height level of said movable panel by said push-up mechanism; and said cutter unit comprises:

a cutter receiving base, held in said outer cutter frame, coaxially penetrated through by said drive shaft;

a swivel case holder held so as to be movable up and down within a predetermined range in said cutter receiving base, said swivel case holder having swivel case supporting portions positioned on a curved surface which opens upward from below said outer cutter;

a substantially bowl-shaped swivel case enclosing a lower portion of said inner cutter and being held by said swivel case holder so as to slide on said swivel case supporting portions of said swivel case holder and swivel in any direction;

an outer cutter ring secured so as to be detachable to an upper edge of said swivel case, thus securing an outer edge of said outer cutter to said upper edge of said swivel case; and a return spring provided between said swivel case and said movable panel which is held so as to be movable up and down in said cutter receiving base thus for returning said swivel case to a positioned coaxial with said drive shaft; and wherein said swivel case is provided to swivel together with said outer cutter by allowing said swivel case to slide on said swivel case supporting portions of said swivel case holder, and said swivel case is provided to be movable up and down together with said swivel case holder.

2. The rotary electric shaver according to claim 1, wherein a center of said curved surface where said swivel case supporting portioning portions of said swivel case holder are located is provided near the center of the top surface of said outer cutter.

3. The rotary electric shaver according to claim 1, wherein said swivel case bolder is provided with a concave portion extending inwardly substantially along a curved surface that opens upward, and said swivel case is provided with a tongue-shaped hook that engages a lower surface of said concave portion from an inside thereof.

4. The rotary electric shaver according to claim 3, wherein said swivel case has a cylindrical part protruding downward through an inside of a concave portion of said swivel case holder, and said return spring is a conical coil spring that is provided between a lower end of said cylindrical part and said movable panel.

5. The rotary electric shaver according to claim 1, wherein said swivel case supporting portions provided in said swivel case holder are rail-shaped along a circular arc located on said curved surface.

6. The rotary electric shaver according to claim 1, wherein said swivel case is formed with a plurality of hooks protruding upward from an inside thereof with tip ends thereof bent inwardly, and said plurality of hooks engaging a boss part in said inner cutter when said outer cutter is removed from said swivel case, thus preventing said inner cutter from being separated form said swivel case.

7. The rotary electric shaver according to claim 1, wherein said outer cutter frame comprises:

a push-up member for pushing up said movable panel;

an advancing and retracting member for advancing and retracting from a side below said push-up member and contacting a lower surface of said push-up member with a cam surface in between; and a control member for changing a position of advance and retraction of said advancing and retracting member.

8. The rotary electric shaver according to claim 7, wherein said control member is held in said outer cutter frame so as to freely turn with an offset wheel integrally formed therewith, and an outer wheel, enclosing said offset wheel so as to be slidable, is formed in one end of said advancing and retracting member.

* * * * *